United States Patent [19]

Washington et al.

[11] 4,009,091

[45] Feb. 22, 1977

[54] SKIPPING SINE WAVE PULSE PLATER SYSTEM

[75] Inventors: Harold Washington, Countryside; Martin Kozi, Berwyn, both of Ill.

[73] Assignee: Instrumentation & Control Systems, Inc., Addison, Ill.

[22] Filed: Apr. 27, 1976

[21] Appl. No.: 680,727

[52] U.S. Cl. ..... 204/228; 204/DIG. 8; 204/DIG. 9

[51] Int. Cl.[2] ..... C25B 15/02; C25D 21/12

[58] Field of Search ..... 204/228, DIG. 8, DIG. 9

[56] References Cited

UNITED STATES PATENTS

| | | | |
|---|---|---|---|
| 3,752,754 | 8/1973 | Olson et al. | 204/228 |
| 3,775,267 | 11/1973 | Yahalom | 204/DIG. 8 |
| 3,857,766 | 12/1974 | Woods | 204/DIG. 8 |
| 3,886,053 | 5/1975 | Leland | 204/228 |
| 3,959,088 | 5/1976 | Sullivan | 204/DIG. 8 |

*Primary Examiner*—John H. Mack
*Assistant Examiner*—D. R. Valentine
*Attorney, Agent, or Firm*—Alter and Weiss

[57] ABSTRACT

A pulse plating system wherein the duty cycle is controlled by skipping pulses in producing the output signal. The circuitry for controlling the skipping of the pulses can either be analog or digital type circuitry.

10 Claims, 2 Drawing Figures

SKIPPING SINE WAVE PULSE PLATER SYSTEM

Figure 1:
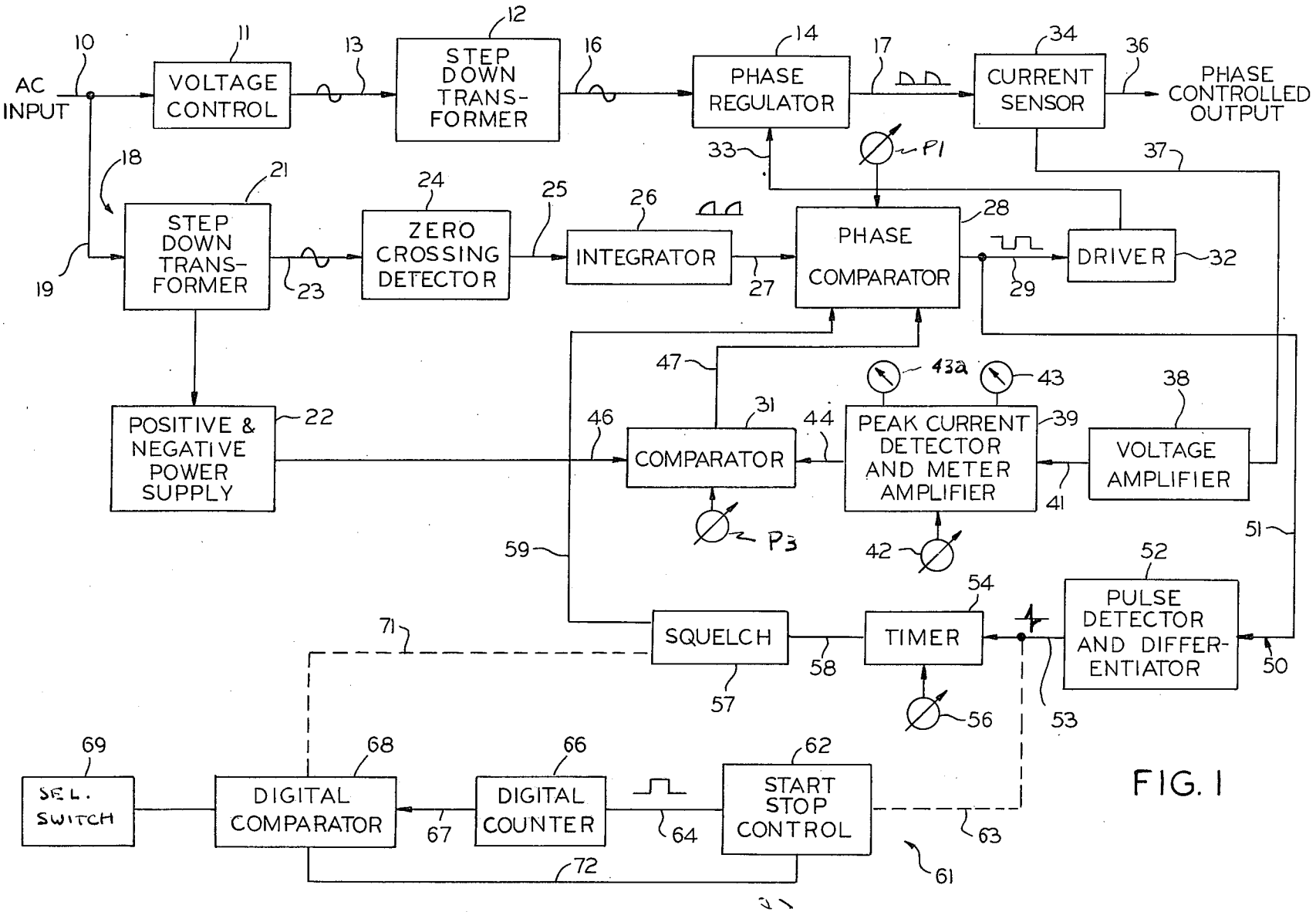

This invention is concerned with electroplating; and more particularly, with pulse plating systems especially useful when applying precious metal platings.

Originally, electroplating was accomplished by connecting the devices to be plated as cathodes and placing the devices into a solution or electrolyte containing ions of the plating metal. Direct current was usually used and was obtained by converting alternating current into direct current by means of rectifiers. The anode was usually a composition material including the metal used in the plating process. With noble metals, such as gold, acid or cyanide solutions are used as the electrolyte with the best results.

Ionization of the electrolyte continues through the process of electrolysis as long as voltage is applied across the electrodes.

Before too long it was discovered that more efficient plating could be accomplished by using direct current plates, rather than continuous direct current. With continuous direct current applied between the electrodes impurities having a polarity opposite to the polarity of the electrode being plated build up around the electrode being plated and act as insulators. To overcome the build up of the insulating impurities, pulse techniques were developed. Further, it was discovered that pulsing techniques were more efficient for electroplating, because it made it possible to use higher current densities. Originally, the pulsing was accomplished using contactors controlled by timers. When using the contactors it is necessary to also open the alternating current lines to prevent the transient surges which would otherwise occur because of the inductive reactance of the transformer circuits.

Thus, complicated circuitry was necessary to protect the contactors. One solution to that problem is the use of saturable reactors or magnetic amplifiers for controlling the pulses applied to the electroplating system. However, a drawback of the saturable reactor pulse system is the inability to control the duty cycle of the pulses.

Another pulse system of recent vintage relies on pulse generators comprising solid state components. In this system, a solid state component, such as a silicon controlled rectifier, is connected to a reduced voltage alternating current source. The gate of the silicon controlled rectifier is controlled by electronic components, designed to open the silicon controlled rectifier gate at a given point in the phase of the alternating current providing an output current whose duty cycle is phase controlled. Feedback circuitry in the system is used to control the phase and amplitude of the output plating signal. Here again, the major problem of the system is the lack of control of the duty cycle once it is set.

Accordingly, an object of the present invention is to provide new and unique pulse skipping pulse plater systems for providing the electrode plating current.

Yet another object of the present invention is to provide pulse plater systems wherein the duty cycle can be readily modified between 25 percent and 50 percent.

A related object of the present invention is to provide skipping sine wave pulse plater systems wherein the duty cycle is controlled by squelching a fixed number of input sine waves. The fixed number is readily variable.

Yet another object of the present invention is to provide skipping sine wave pulse plating system wherein the duty cycle is controlled by squelching a number of input sine waves. The number of sine waves skipped being a function of a variable time period. Thus, the duty cycle is controlled by varying the time period.

Another object of the present invention is to provide skipping sine wave pulse plater systems wherein the duty cycle is controlled by using a pulse signal to operate a digital counter. The pulse signal activates the gate of the silicon controlled rectifier to initiate a count by a digital counter. The sine waves are squelched until the desired count is attained.

A further related object of the present invention is to provide pulse skipping pulse plater systems which can be used with periodic reverse current plating or with uni-directional current plating.

Figure 2:
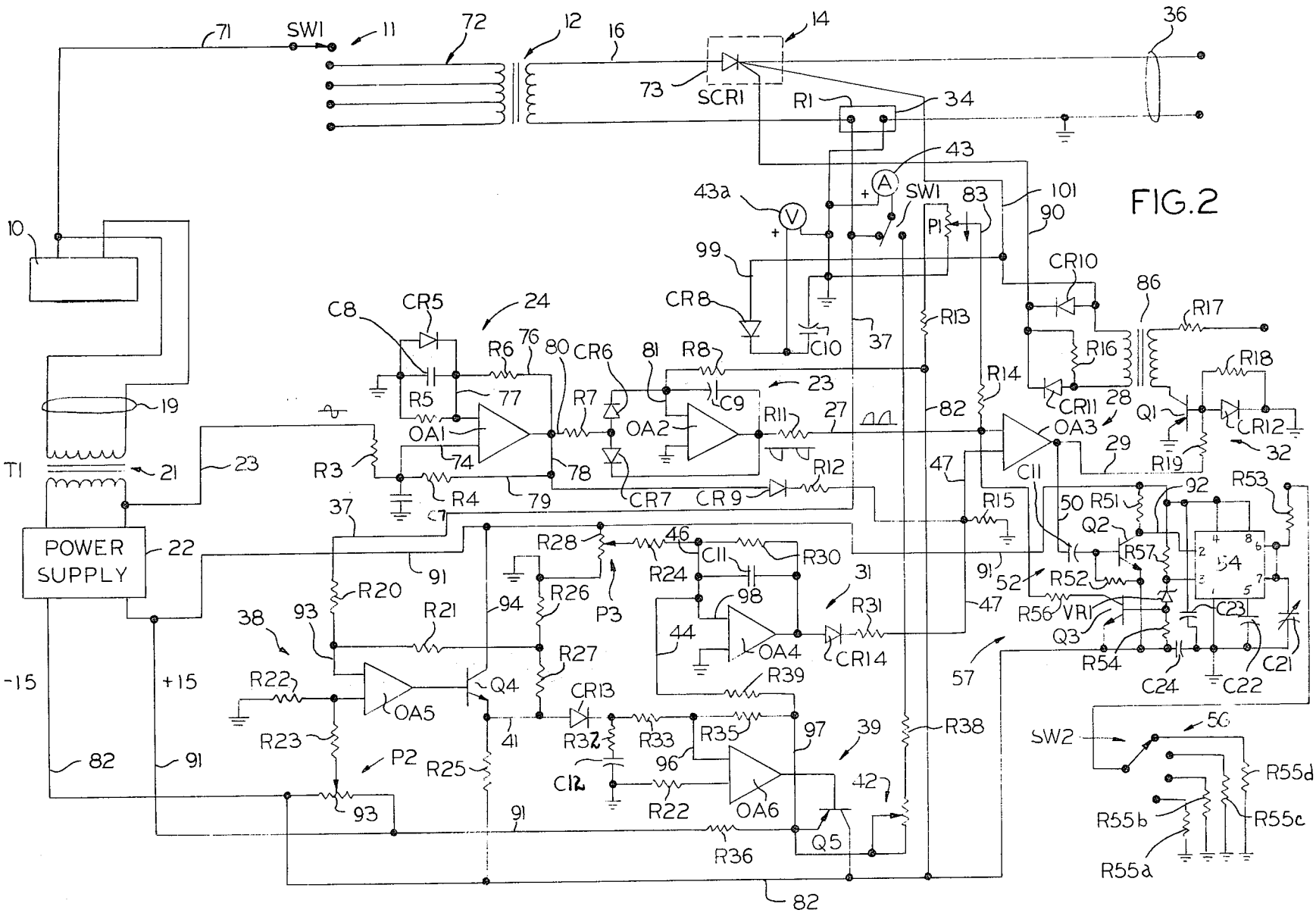

The above mentioned and other objects and features of the invention will be best understood by making reference to the following description and accompanying drawings, wherein:

FIG. 1 is a block diagram of the pulse skipping pulse plater system, shown using an analog timing system and an alternate digital system for controlling the duty cycle; and FIG. 2 is a schematic showing of the pulse skipping pulse plater of FIG. 1 using the analog timing system for controlling the duty cycle.

The basic pulse control system of the pulse skipping pulse plater is shown in FIG. 1. Means are provided for controlling the applied peak voltage to the electroplating system. More particularly, as shown in FIG. 1, an alternating current input 10 is supplied to a voltage control device shown as 11. The voltage control device can be any means, such as a transformer tapping arrangement, for adjusting the peak voltage. The controlled peak sine wave voltage is then coupled to a step-down transformer 12 over conductor 13.

Means are provided for controlling the portion of the sine wave on the phase of the pulses delivered to an electroplating system. More particularly, the voltage output of the step-down transformer is delivered to a phase regulator 14 over conductor 16.

Means are provided for controlling the phase regulator to enable passage therethrough of the signal as the sine wave on conductor 16 is going positive. More particularly, this last named means is accomplished using the feedback control circuitry shown generally at 18. Therein the alternating current input 10 is fed through conductor 19 to a step-down transformer 21. The step-down transformer is also used for supplying the positive and negative power supply 22 used in conjunction with the transistorized and solid state circuitry contained in the blocks of FIG. 1.

The lower voltage on the output conductor 23 at the output portion of the step-down transformer 21 is transferred to zero crossing detector 24. The zero crossing detector in a preferred embodiment is a readily available commercial unit, for example an operational amplifier 741 connected to provide a pulsed output responsive to the sine wave input. Therein, everytime the sine wave input crosses the zero axis in a positive direction, a pulse is provided. As the sine wave crosses the zero axis in the negative direction, no output is obtained until the sine wave again crosses the zero axis in a positive direction. Thus, the zero crossing detector provides a pulse for every positive portion of the original sine wave line signal. This pulse appears on conductor 25 which extends from the zero crossing detector 23 to an integrator 26. The integrator 26 converts the positive pulses to a ramp or saw tooth output. The saw tooth wave appears on conductor 27 which is one input to a phase comparator 28.

The output on conductor 29 of the phase comparator 28, which is an operational amplifier type 741, is a square wave pulse train. The pulse train, of course, occurs only when the phases of the saw tooth pulse on conductor 27 and the phase of another comparator 31 are sufficiently different.

The square wave pulse train is delivered to a driver circuit 32 which essentially isolates and amplifies the pulses. The output of the driver 32 is connected through conductor 33 to the phase regulator circuit 14.

Responsive to the drive pulses on conductor 33, the regulator controls the passage of the number of positive portions of the sine wave as desired onto conductor 17. The conductor 17 is series connected through a current sensor 34 to provide a phase controlled output to an electroplating system electrode, such as the anode of a precious metal plating system.

The feedback control signal output of the current sensor appears on conductor 37 and is used as the basic feedback signal to the phase comparator for maintaining the peak current desired through the electroplating electrodes.

The conductor 37 feeds into a voltage amplifier 38 which is also a type 741 operational amplifier. The output of the voltage amplifier 38 is connected to a peak current detector and meter amplifier circuit 39 through conductor 41. The peak current detector and meter amplifier is controlled by a meter control potentiometer 42. The detector is also basically a type 741 operational amplifier.

One output of circuit 39 operates meter 43 to indicate the peak current connected to comparator 31 through conductor 44. The comparator 31 also has a direct current reference input on conductor 46, which is taken from the positive and negative power supply 22. If the peak current at conductor 44 is above or below the direct current on conductor 46, then the output of the phase comparator 28 is automatically varied to bring that peak signal on conductor 44 up to the reference signal on conductor 46.

The peak current received at the phase controlled output 36, of course, is adjustable by varying the point on the sine wave input on conductor 16 at which the phase regulator 14 operates to conduct. When the phase regulator 14 operates to conduct, at the 90*L* point of the sine wave curve on conductor 16, then the peak current is at its maximum. When the phase regulator 14 operates to conduct after the 90*L* point, then the peak current is diminished. The output of the signal comparator 31 connected to the phase comparator 28 through conductor 47 is compared with the saw tooth pulse train input on conductor 27 to provide a square wave pulse train output that is a function of the current fed back from sensor 34.

The width of the square wave, and consequently the point of operation of the phase regulator 14, is varied by the output of comparator 31. The circuitry, including the current sensor 34, voltage amplifier 38, detector and amplifier 39, and comparator 31 act to provide a constant current to the output 36 by varying the duty cycle of the output signal.

To reduce the duty cycle, while, nonetheless, maintaining the constant current output, new and unique circuitry has been added. The circuitry of FIG. 1 includes the analog feedback system, shown generally at 50. The analog feedback system includes conductor 51 which is connected to conductor 29 and enables the pulse train output of phase comparator 28 to be connected to a pulse detector and differentiator circuit 52. The output of circuit 52 appears on conductor 53 as a sharp pulse. The sharp pulse on conductor 53 operates a timer circuit 54. The timer time is varied by control 56 to provide the desired time period during which there is no output from the phase regulator.

The timer produces an output signal on conductor 58 responsive to the differentiated spike input signal. The signal from the timer activates a squelch circuit 57 which produces an output on conductor 59 which inhibits the operation of the phase comparator circuit 28. As long as the phase comparator circuit is inhibited, the phase regulator 14 is not energized, and there is no flow through circuit 14.

When the time period selected is over, the timer signal turns off causing the squelch signal to turn off, and therefore, there is no inhibit circuit signal on circuit 28. The output signals of comparator 28 are then used for operating phase regulator circuit 14 to provide the desired peak current output. Thus, the peak current is maintained constant by feedback circuit 18, but the duty cycle is varied in accordance with the analog feedback circuit 50.

The resulting lower controlled current enables a finer grain plating than is provided by the non-controlled current previously obtained.

In a second embodiment of the invention the skipping of pulses is controlled digitally, by circuitry shown generally as 61. A "start and stop" control circuit 62 is coupled to the pulse detector and differentiator through conductor 63. Conductor 63 is shown in dashed lines to indicate that the embodiment of arrangement 61 is not used in conjunction with the analog equipment 50.

The start and stop control circuit 62 is preferably an AND gate, flip-flop type circuit, such as provided by a solid state series 7454 type logic circuit manufactured by Intel, among others. The start and stop control flip-flop circuit provides a pulse responsive to the spike signal received over conductor 63. The start and stop pulse is transmitted over conductor 64 to a digital counter 66. Responsive to the pulse on conductor 64, the digital counter starts to emit counting pulses. These counting pulses are transmitted over conductor 67 to a digital comparator circuit 68. The digital comparator signal produces a squelch circuit activating signal on conductor 71. The digital counter circuit 66 preferably is a commercially available counter 64161 type made by Intel, among others.

The digital comparator circuit is commercially available type 7485 comparator made by Intel, among others. Means are provided to control the comparator circuit, for example, a selector switch 69 sets the digital comparator to transmit a signal over conductor 72, after it has received the number of pulses set by the selector switch 69. The signal transmitted over conductor 72 goes back to the start-stop circuit and causes that circuit to send a signal which stops the counter causing the signal on conductor 71 to go to zero, thereby inhibiting the squelch circuit.

The signal from the digital comparator to the squelch circuit causes that circuit to send a squelch signal over conductor 59 to the phase comparator to squelch any signal coming from the peak comparator, and thereby inhibit the phase regulator preventing any peak current from being transmitted to the phase controlled output 36 during the operation of the digital counter. So long as the digital counter is sending its pulses to the digital comparator, the digital comparator is sending a signal to the squelch circuit 57 to suppress the phase comparator. When the input to the digital comparator matches the setting of the selector switch 69, the comparator puts out a signal onto conductor 72 to reset the start-stop control circuit and turn off the counter and the squelch circuit, thereby enabling the next output pulse to be applied to the load. Once the pulse has been applied to the load, the timing cycle is reinitiated.

A schematic of the pulse skipping pulse plater system using the analog timing system for duty cycle control is shown at FIG. 2. Therein the alternating current input power source is shown at 10. It is coupled to a voltage control unit 11 through a conductor 71. The voltage control unit 11 comprises a tapping switch SW1 and the taps 72 on the primary of step-down transformer 12. The voltage on the conductor 16 going to phase regulator 14 is thereby controlled in a preferred embodiment.

The phase regulator used in that preferred embodiment of this invention is a silicon controlled rectifier shown as SCR1. The silicon controlled rectifier SCR1 is shown surrounded by heat sink 73. The phase controlled output is connected to a load through conductors 36. A current sensor 34 is in series with the load and is shown as a shunted resistor R1.

Also, connected to the alternating current source through conductors 19 is a step-down transformer 21. The step-down transformer provides alternating current power to power supply 22 which provides the positive and negative voltages required throughout the circuitry. An alternating current signal is coupled from the secondary of the step-down transformer 21 through resistor R3 to the input of zero crossing detector circuit 24.

More particularly, one side of the secondary winding of the step-down transformer 21 is coupled through conductor 23, resistor R3 and conductor 74 to the non-inverting input of operational amplifier OA1. The input to the operational amplifier OA1 therefore is a sine wave. Positive feedback is connected to the non-inverting input of operational amplifier OA1 through conductors 78, 79, resistor R4 and conductor 74. The junction of resistors R4 and R3 is coupled to ground through filter capacitor C7.

Gain control is supplied by connecting the negative or inverting input of operational amplifier OA1 to the output of the amplifier through conductor 76, resistor R6 and conductor 77. The junction of resistor R6 and the negative input of operational amplifier OA1 is connected to ground through resistor R5, bridged by filter capacitor C8. Thus, the gain of the operational amplifier is determined by the voltage divider network made up of resistors R6 and R5.

Means are provided for assuring a positive output signal from operational amplifier OA1. More particularly, a diode CR5 having its anode coupled to ground also bridges resistor R5. The diode CR5 markedly affects the gain when the output of operational amplifier OA1 is negative. Thus, if there is a negative output from operational amplifier OA1, this negative output is effectively squelched. Consequently, the output of operational amplifier OA1 is a series of positive squared off pulses separated by the smaller negative pulses in phase with the full sine wave input of the operational amplifier OA1. The output of operational amplifier OA1 is also connected to ground through conductor 78, diode CR9 in series with resistors R12 and R15.

The output signal of operational amplifier OA1 of the zero crossing detector 24 is coupled to an operational amplifier OA2 that is part of the integrator circuiry 23 through conductor 79, resistor R7, diode CR6, and conductor 81 connected to the inverting input of the operational amplifier OA2. The output of the operational amplifier OA2 is connected to the negative or inverting input of that amplifier through integrating capacitor C9 and conductor 81. The junction of diode CR6, capacitor C9 and conductor 81 is coupled to negative voltage on negative voltage bus 82 through resistor R8.

The non-inverting input of operational amplifier OA2 is connected directly to ground. The junction of resistor R7 and diode CR6 is connected to the output of operational amplifier OA2 through diode CR7.

The capacitor C9 is normally charged through resistor R8 placing a negative signal on the inverting input of amplifier OA2; and, consequently, a positive signal on the output of operational amplifier OA2. When the output of operational amplifier OA1 is positive, then the capacitor discharges and the output of amplifier OA2 is clamped through diode CR7. Thus, the input of operational amplifier OA2 is integrated by the time function of resistor R8 and capacitor C9. The form of the output is a positive going saw tooth as shown, which is the square wave input wave form integrated.

The output of the integrator 23 is coupled to the phase comparator circuitry 28 through resistor R11 and conductor 27. Conductor 27 is tied to the inverting input of an operational amplifier OA3 and also to negative power bus 82, through resistor R14 and the wiper 83 of a phase adjust potentiometer P1. The resistance coil of the potentiometer P1 is coupled between ground and negative voltage bus 82 in series with resistor R13.

The non-inverting input of operational amplifier OA3 is connected to the comparator 31 through conductor 47. Thus, the phase comparator 28 compares the inputs from the integrator 26 and the comparator 31.

The output of the phase comparator is coupled to the drive circuitry 32 through conductor 29. More particularly, the output of operational amplifier OA3 is coupled through conductor 29 and resistor R19 to the base of PNP transistor Q1. The base of transistor Q1 is coupled to ground through resistor R18 bridged by diode CR12. Diode CR12 has its cathode connected to ground. The emitter of transistor Q1 is coupled directly to ground and the collector is coupled to transformer 86.

The operation of transistor Q1 controls the phase regulator silicon controlled rectifier SCR1. More particularly, the operation of transistor Q1 affects the current through primary winding of transformer 86. The secondary winding of the transformer is attached to the gate of the silicon controlled rectifier SCR1 through conductor 90, diodes CR10 and CR11 bridged by resistor R16. The anode of silicon controlled rectifier SCR1 is connected directly to the secondary of transformer 86 through conductor 101. The diodes rectify the output of the secondary of the transformer 86.

Conduction is enabled through the silicon controlled rectifier by the signal on the gate conductor 90. The signal flows for only the positive half wave coming through transformer 12 after which no signal flows through the silicon controlled rectifier SCR1 until the next portion of the signal is enabled by the voltage on the gate.

The amplitude of the voltage on the gate is controlled by phase adjustment potentiometer P1 which controls the input signal to the inverting input of operational amplifier OA3 and consequently, the output of transistor Q1 and the secondary of transformer 86. When the output of amplifier OA3 is negative, transistor Q1 conducts to ground the primary of transformer 86 and consequently, kill an enabling signal to gate conductor 90. In the absence of the negative signal, the gate causes silicon controlled rectifier SCR1 to conduct every half cycle.

The output of the operational amplifier OA3 of phase comparator 28 is also coupled to a pulse detector and differentiator circuit 52 through conductor 50. The conductor 50 is coupled to the base of NPN transistor Q2 through capacitor C11. The emitter of transistor Q2 is coupled to negative voltage bus 82. The collector of transistor Q2 is coupled to the positive voltage bus 91 through resistor R51. The collector of transistor Q2 is also coupled to the "2" terminal of a timer circuit U1 in a preferred embodiment of the invention is a commercially available type 555 timer, such as manufactured by Intel, for example.

The output of the phase comparator is a pulse whose amplitude varies about the zero point. The detector and differentiator circuit 52 differentiates the pulse through capacitor C11 and resistor R52, coupled between the base and emitter of transistor Q2. The differentiated spiked pulse appears at the collector of transistor Q2 where it is connected to the "set" input terminal "2" of timing circuit 54.

In the meantime, the sensed current received from the current sensor R1 is transmitted through conductor 37, resistor R20, and conductor 93 to the inverting input of voltage amplifier 38 comprising operational amplifier OA5 and associated circuitry. Coupled to the non-inverting input of operational amplifier OA5 is a negative signal obtained from negative bus 82 through potentiometer P2 having its winding 93 extending between negative bus 82 and positive bus 91. The winding 93 of potentiometer P2 is connected to the positive input of operational amplifier OA5 through resistor R23 and the wiper of potentiometer P2 in series. The potentiometer P2 acts as a meter offset control.

The junction of resistor R23 and the positive input of operational amplifier OA5 is coupled to ground through resistor R22. The junction point of conductor 37 and resistor R20 is coupled to ground through resistor R21 and resistor R26.

The output of operational amplifier OA5 is coupled to the base of NPN transistor Q4. The collector of NPN transistor Q4 is coupled to positive voltage bus 91 through conductor 94. The bus 91 is grounded through the winding R28 of potentiometer P3. The emitter of transistor Q4 is coupled to the negative voltage bus 82 through conductor 96 and resistor R25. The junction of resistor R25 and the emitter of transistor Q4 is coupled to the negative or inverting input of operational amplifier OA6 through conductor 41, diode CR13, resistor R33 and conductor 96. The coupling point of conductor 41 and diode CR13 is coupled to ground through resistor R27 in series with resistor R26. Since resistor R21 is coupled from the inverting input of operational amplifier OA5 to the junction of resistors R27 and R26, there is a feedback path through resistors R27 and R21 from the output of amplifier cicuitry 38 to its input.

The voltage amplifier circuitry 38 converts the sensed current of current sensor 34 into a voltage and amplifies that voltage. The amplified voltage is fed into a peak current detector and meter amplifier 39 comprising operational amplifier OA6 and associated circuitry, including PNP transistor Q5.

When the amplified voltage is sufficiently positive to forward bias diode CR13, then its peak is detected at operational amplifier OA6. The positive voltage is bridged to ground through resistance R32 and capacitor C12. As the voltage amplifier circuitry 38 amplifies, then the signal on inverting input of operational amplifier OA6 becomes more positive giving a negative output for amplifier OA6, which in turn is applied to the base of transistor Q5 causing that transistor to conduct more.

As transistor Q5 conducts more, a negative voltage is applied to the inverting input of operational amplifier OA4 connected as comparator 31. More particularly, the negative voltage is supplied from negative bus 82 through transistor Q5, conductor 97, resistor R39 and conductors 44 and 98. This negative signal is also fed back to the inverting input of operational amplifier OA6 through conductor 97, resistor R35 and conductor 96. The negative feedback voltage tends to back bias diode CR13 and also to discharge capacitor C12. The positive or non-inverting input of amplifier OA6 is tied to ground through resistor R22.

Operational amplifier OA4 and its associated circuitry compares the signal received from peak current detector 39 to the current obtained from positive bus 91 through potentiometer P3.

Transistor Q5 has its emitter coupled to positive bus 91 through resistor R36. Thus, a variable negative signal is supplied to peak current detector 39 over conductor 97, resistor R39 and conductor 44. The negative voltage received through transistor Q5 of the peak current detector, therefore, is compared at conductor 46 to the signal received from the wiper of potentiometer P3 through resistor R24. When the negative signal from transistor Q5 surpasses the positive voltage applied to conductor 46 through resistor R24, then the signal on conductor 98 is positive. Thus, in effect, the input to the negative or inverting input of operational amplifier OA4 is determined by the amplification supplied by transistor Q5 which in turn is determined by the peak value at the output of operational amplifier OA6.

The gate of operational amplifier OA4 is determined by feedback resistor R30 bridged by capacitor C11 both of which are connected between the output of amplifier OA4 and the inverting input through conductors 46 and 98. The non-inverting input of amplifier OA4 is connected directly to ground. The positive output of comparator circuit 31 is transferred through blocking diode CR14, resistor R31, conductor 47 and resistor R15 to ground. Conductor 47 also feeds into the non-inverting input of operational amplifier OA3 of phase comparator 28.

The peak current detector and meter amplifier circuit 39 is also connected to meter means, such as ammeter 43, through a circuit that extends from conductor 97, rheostat 42, resistor R38 and switch SW1 to the ammeter 43 and to ground on the other side of the ammeter switch SW1, which also connects ammeter 43 across current sensor R1 when desired.

A volt meter 43*a* is also shown coupled between ground and the junction point of diode CR8 and filter capacitor C10. The other side of capacitor C10 is also coupled to ground. The cathode of diode CR8 is coupled to the capacitor, and the anode of diode CR8 is coupled to the cathode of silicon controlled rectifier SCR1 through conductors 99 and 101. Conductor 101 is also coupled directly to one side of the secondary of transformer 86.

Means are provided for controlling the phase controlled output to cause it to skip pulses. More particularly, the phase comparator circuit 28 is provided with feedback which squelches the driver signal coming out of the phase comparator 28 and appearing on conductor 29. The output of the phase comparator is fed to the pulse detector and differentiator circuit 52 as previously described. The differentiated, detected pulses operate the timer circuit 54. The time period during which pulses are squelched is controlled by rotary switch SW2, shown as period selector 56 in FIG. 1. It comprises a rotary switch having a multiplicity of resistors R55*a*, R55*b*, R55*c* and R55*d* for changing the time period, for example.

The wiper is coupled to input "6" and "7" of timer U1 through resistor R53. Terminals "6" and "7" of timer U1 are coupled to ground through capacitor C22; while terminals "4" and "8" are coupled to ground through capacitor C23.

Means are provided for squelching the output of phase comparator 28 under the control of timer U1. More particularly, squelch circuit 57 is shown as comprising transistor Q3. The base of transistor Q1 is coupled to the negative voltage bus 82 through resistor R54. The emitter of NPN transistor Q3 is coupled directly to the negative voltage bus 82. The collector of transistor Q3 is coupled to the inverting input of the phase comparator OA3 through resistor R56.

The coupling point of the base of transistor Q3 and resistor R54 is connected to the positive bus 91 through voltage regulator VR1 and resistor R57. The coupling point of resistor R57 and the cathode of the voltage regulator VR1 is coupled to the output terminal "3" of timer 54. The junction point of resistor R55 and negative bus 82 is coupled to ground through capacitor C24.

The differentiated signal from the collector of transistor Q2 of the pulse detector and differentiator 52 is connected to a trigger terminal "2" on timer 54. Responsive to the trigger signal, a positive monostable output pulse is applied to the base of transistor Q3 causing transistor Q3 to conduct a negative signal to the inverting input of operational amplifier OA3. Responsive to this negative signal the output of operational amplifier OA3 goes positive, effectively squelching the output of the phase comparator 28 and the driver 32 by preventing the operation of transistor Q1.

The squelching signal from circuit 57 lasts as long as the monostable pulse is received from timer circuit 54, regardless of whether or not the pulse detector and differentiator circuit 52 provides additional pulses. After the monostable pulse ceases at terminal "3", a reset pulse is provided by capacitor C23 to the reset terminal "4."

In operation then, the output phase controlled current on conductor 36 is completely regulated. The phase regulator 14 under control of phase comparator 28 and the feedback circuitry consisting of the current sensor 34, voltage amplifier 38, peak current detector 39 and comparator 31, controls the phase regulator causing it to provide even a 90° conduction angle and therefore a duty cycle that is between a 50% and 25% duty cycle.

The further feedback circuit used to squelch pulses comprising the pulse detector 52 and the analog or digital control circuits 54 or 62, 66, 68 and 69, respectively, provide a reduced duty cycle of less than 25% while maintaining a constant output amplitude.

While the principles of the invention have been described above in connection with specific apparatus and application, it is to be understood that this description is made by way of example only, and not as a limitation on the scope of the invention.

We claim:

1. A skipping sine wave pulse plating system for providing power from an alternating current source to electrodes in an electro-plating bath, said system comprising voltage control means for controlling the amplitude of the power provided to said electrodes, duty cycle control means for controlling the duty cycle of the power applied to said electrodes by conducting only during prescribed phases of said alternating current, means for connecting said duty cycle control means to said electrodes, power sensing means in said connecting means for determining the power provided to said electrodes, drive circuit means for controlling said duty cycle control means, phase comparator means associated with said drive circuit means for setting said duty cycle by controlling the prescribed phases, drive circuit control means operated responsive to said power sensing means for controlling said drive circuit means to maintain the duty cycle as set, and squelching means for controlling the output of said drive circuit means to enable reducing the duty cycle to a condition of less than 25 percent while still maintaining a constant output amplitude.

2. The skipping sine wave pulses plating system of claim 1 wherein the voltage control means comprises transformer means for controlling the alternating current input voltage from the alternating current source to a desired amplitude; and wherein said means for controlling the drive circuit means to reduce the duty cycle to a condition of less than 25 percent comprises means for eliminating output pulses for a selected number of periods with respect to the alternating current input line.

3. The skipping sine wave pulse plating system of claim 1 wherein said duty cycle control means comprises phase regulator means, said phase regulator means being in series between said current sensing means and said voltage control means, and being normally non-conducting, and means for operating said phase regulator means to conduct responsive to the output of said driver circuit means so as to provide a duty cycle as set by said phase comparator means.

4. The skipping sine wave pulse plating system of claim 3 wherein said drive circuit means comprises:

means responsive to the alternating current input for generating a saw tooth wave form signal, means including said phase comparator operated responsive to said saw tooth wave form for providing a drive pulse to said phase regulator means to operate said phase regulator to conduct, whereby the output of said phase regulator means is a series of modified half wave pulses.

5. The skipping sine wave pulse plating system of claim 4 including first feedback circuit means for maintaining the amplitude of the output of the said phase regulator means constant.

6. The skipping sine wave pulse plating system of claim 5 wherein said first feedback circuit means comprises means for comparing the output of said current sensing means and a standard signal, and means responsive to the output of said current sensing means being different than said standard signal for varying the output of said drive circuit means to change the conduction point of said phase regulator means and thereby vary the output from said phase regulator so that the output produced by said current sensor matches the standard signal.

7. The skipping sine wave pulse plating system of claim 6 wherein the squelching means for reducing the duty cycle to a condition of less than 25 percent while maintaining the output amplitude constant comprises detector means coupled to the output of said phase comparator, timer means responsive to said detector means detecting a pulse output from said phase comparator means for providing a signal that extends for a set period of time, and squelch circuitry operated responsive to said signal from said timer means for preventing an output from said driver means, whereby said phase regulator means is inhibited from conducting for said set period of time reducing the duty cycle.

8. The skipping sine wave pulse plating system of claim 6 wherein the means for reducing the duty cycle to a signal of less than 25 percent includes means coupled to the output of said phase comparator for detecting a signal from said phase comparator, means responsive to the start-stop control means operated responsive to the operation of said detector means, digital counter means operated responsive to the start-stop control means for counting the pulses from said start-stop control means, digital comparator means coupled to the output of said digital counter, squelch circuit means, said digital comparator providing a signal to said squelch circuit means responsive to a signal from said digital counter, said squelch circuit means providing a signal to said phase comparator to inhibit an output from said phase comparator while said squelch signal is receiving a signal from said digital comparator, switch means for providing a stopping signal to stop said signal from said digital comparator to said squelch circuit when the signal from said digital counter equals a signal from said digital generator, whereby said set signal from said squelch circuit is inhibited, and said digital comparator providing a signal to said start-stop control circuit responsive to said stopping signal, thereby turning off said digital counter circuit.

9. The skipping sine wave pulse plating system of claim 3 wherein said phase regulator means comprises a silicon controlled rectifier, said voltage controlled means being coupled to the anode of said silicon controlled rectifier, said drive circuit means being coupled to the gate of said silicon controlled rectifier and the electrodes of said electroplating bath being coupled to the cathode of said silicon controlled rectifier.

10. A skipping sine wave pulse plating system for providing pulse power from an alternating current source to electrodes in an electro-plating bath, said system comprising means for monitoring the output of said system, phase regulator means for determining the pulse width of the pulses emitted from said system, first feedback means for controlling the phase of said pulses relative to said input alternating current, second feedback means for controlling the amplitude of said pulses, and third feedback means for controlling the number of pulses per period to thereby provide completely controlled output pulses with regard to phase, amplitude and duty cycle.

* * * * *

UNITED STATES PATENT OFFICE

CERTIFICATE OF CORRECTION

Patent No. 4,009,091 Dated February 22, 1977

Inventor(s) Harold WASHINGTON & Martin KOZI

It is certified that error appears in the above-identified patent and that said Letters Patent are hereby corrected as shown below:

Col. 3, line 52: Numeral 90L (slug) should read: --90°--

Col. 3, line 55: Numeral 90L (slug) should read: --90°--

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*